US010047588B2

(12) United States Patent
Bennetzen et al.

(10) Patent No.: US 10,047,588 B2
(45) Date of Patent: Aug. 14, 2018

(54) CONTROLLED ALTERNATING FLOW DIRECTION FOR ENHANCED CONFORMANCE

(71) Applicant: Maersk Olie og Gas A/S, Copenhagen (DK)

(72) Inventors: Martin Bennetzen, Doha (QA); Kristian Mogensen, Doha (QA)

(73) Assignee: Maersk Olie OG Gas A/S, Copenhagen K (DK)

( * ) Notice: Subject to any disclaimer, the term of this patent is extended or adjusted under 35 U.S.C. 154(b) by 75 days.

(21) Appl. No.: 14/909,635

(22) PCT Filed: Jul. 30, 2014

(86) PCT No.: PCT/EP2014/066376
§ 371 (c)(1),
(2) Date: Feb. 2, 2016

(87) PCT Pub. No.: WO2015/014893
PCT Pub. Date: Feb. 5, 2015

(65) Prior Publication Data

US 2016/0177662 A1 Jun. 23, 2016

(30) Foreign Application Priority Data

Aug. 2, 2013 (GB) ..... 1313899.5

(51) Int. Cl.
*E21B 33/138* (2006.01)
*E21B 43/20* (2006.01)
*E21B 43/16* (2006.01)

(52) U.S. Cl.
CPC ..... *E21B 33/138* (2013.01); *E21B 43/16* (2013.01); *E21B 43/20* (2013.01)

(58) Field of Classification Search
None
See application file for complete search history.

(56) References Cited

U.S. PATENT DOCUMENTS 2,786,530 A 3/1957 Maly
3,285,338 A 11/1966 Boston
(Continued)

FOREIGN PATENT DOCUMENTS

WO WO-2004042187 A1 5/2004
WO WO-2013040597 A1 3/2013

OTHER PUBLICATIONS

International Search Report PCT/ISA/210 for International Application No. PCT/EP2014/066376 dated May 18, 2015.
(Continued)

*Primary Examiner* — Anuradha Ahuja
(74) *Attorney, Agent, or Firm* — Harness, Dickey & Pierce, P.L.C.

(57) ABSTRACT

A method for reducing permeability in a first region of a formation, including injecting a first composition in the first region from a first location near and/or adjacent the first region; and injecting a second composition in the first region from a second location near and/or adjacent the first region, wherein the first composition and the second composition are configured to react so as to form a reaction product capable of reducing the permeability in at least a portion of the first region.

27 Claims, 3 Drawing Sheets

(56) References Cited

U.S. PATENT DOCUMENTS 4,069,869 A * 1/1978 Sandiford ..... C09K 8/512 166/270
4,098,337 A * 7/1978 Argabright ..... C09K 8/512 166/270
4,147,211 A * 4/1979 Sandiford ..... C09K 8/50 166/268
4,413,680 A * 11/1983 Sandiford ..... C09K 8/512 166/270
4,693,310 A * 9/1987 Gibbons ..... C09K 8/512 166/270
4,804,043 A * 2/1989 Shu ..... C09K 8/512 166/261
4,809,780 A * 3/1989 Shen ..... C09K 8/60 166/248
4,848,464 A 7/1989 Jennings, Jr. et al.
4,915,170 A * 4/1990 Hoskin ..... C09K 8/887 166/270
4,941,533 A * 7/1990 Buller ..... C09K 8/594 166/246
4,974,677 A * 12/1990 Shu ..... C09K 8/512 166/270
5,018,578 A 5/1991 El Rabaa et al.
6,474,413 B1 * 11/2002 Barbosa ..... C09K 8/501 166/270
7,084,094 B2 * 8/2006 Gunn ..... C09K 8/887 507/221
2006/0157238 A1 7/2006 Ligthelm
2010/0012331 A1 * 1/2010 Larter ..... C09K 8/58 166/401
2011/0265994 A1 * 11/2011 Entchev ..... C09K 8/508 166/270
2013/0075089 A1 3/2013 Bour et al.

OTHER PUBLICATIONS

Written Opinion of the International Searching Authority PCT/ISA/237 for International Application No. PCT/EP2014/066376 dated May 18, 2015.

* cited by examiner

CONTROLLED ALTERNATING FLOW DIRECTION FOR ENHANCED CONFORMANCE

CROSS-REFERENCE TO RELATED APPLICATIONS

This is a National Phase of PCT Patent Application No. PCT/EP2014/066376, filed on Jul. 30, 2014, which claims priority under 35 U.S.C. § 119 to Great Britain Patent Application No. 1313899.5, filed on Aug. 2, 2013, the contents of each of which are hereby incorporated by reference in their entirety.

FIELD OF THE INVENTION

The present invention relates to a method for reducing the permeability of a region of a subterranean formation, and in particular, though not exclusively, to a method for at least partially plugging a high-permeability region of a subterranean formation for subsequent enhanced oil recovery by water, gas, or chemical flooding.

BACKGROUND TO THE INVENTION

Water flooding as an oil recovery technique has been in use since 1890 when operators in the US realised that water entering the productive reservoir formation was stimulating production. In some cases, water is supplied from an adjacent connected aquifer to push the oil towards the producing wells. In situations where there is no aquifer support, water is typically pumped into the reservoir through dedicated injection wells. The water phase replaces the oil and gas in the reservoir and thereby serves to maintain pressure. Recovery factors from water flooding vary from 1-2% in heavy oil reservoirs up to 50% in light oil reservoirs with typically values around 30-35%, much lower than the microscopic sweep efficiency of 70-80%.

A reason for sub-optimal recovery factors is related to the macroscopic sweep, which in turn is a reflection of reservoir heterogeneity and fluid mobility ratios. Fluid mobility ratio may be controlled to some extent by adding viscosifying agents to the injection phase, such as polymers or foams, but the presence of large permeability variations requires a different approach to improve macroscopic sweep. An extreme case is a direct high-permeability conduit, either natural or induced, between an injector and one or more producers, which requires complete or at least partial plugging of the high-permeability conduit. This process is known as conformance control.

Conformance treatments can significantly improve the sweep efficiency of a malfunctioning water flood and is a prerequisite for any Enhanced Oil Recovery (EOR) method. Conformance control generally requires a combination of mechanical and chemical solutions. The role of the mechanical part is to ensure that the chemicals reach the part of the reservoir, which they are intended to plug. Although commercial chemicals already exist for plugging high-permeability zones, the chemical mixture has to be tailored to a particular application, depending on salinity, temperature, pore size etc. When two or more chemicals are required to react and plug a high-permeability zone, the reaction may also cause plugging of other regions of the formation, such as low-permeability zones, thereby lowering productivity during subsequent oil recovery.

Attempts have been made to reduce the permeability of selected zones during profile control.

U.S. Pat. No. 4,848,464 and (Jennings et al.) disclose a method comprising injecting a solidifiable gel containing a gel breaker into a formation where it enters a zone of lesser and a zone of greater permeability. Said gel blocks pores in the zone of lesser permeability. Another solidifiable gel lacking a gel breaker is then injected into the zone of greater permeability where it subsequently solidifies. The gel contained in the zone of lesser permeability (containing a gel breaker) liquefies, thereby unblocking this zone. Afterwards, a water-flooding enhanced oil recovery method is directed into the zone of lesser permeability.

It is amongst the objects of the present invention to obviate and/or mitigate at least one of the aforementioned disadvantages.

SUMMARY OF THE INVENTION

According to a first aspect of the present invention there is provided a method for reducing permeability in a first region of a formation, comprising:

injecting a first composition in the first region from a first location near and/or adjacent the first region; and injecting a second composition in the first region from a second location near and/or adjacent the first region;

wherein the first composition and the second composition are configured to react so as to form a reaction product capable of reducing the permeability in at least a portion of the first region.

The method may comprise reacting, e.g. in situ, the first composition and the second composition to form a reaction product capable of reducing the permeability in at least a portion of the first region.

The formation may typically comprise a subterranean formation.

The first region of the formation may comprise a region of high permeability.

The formation may comprise a second region, such as one or more regions of low permeability. The permeability of the first region may be higher than the permeability of the second region. Although the terms "high" and "low" are relative terms, their meaning will be clearly understood in the context of the present invention to relate to areas of a permeable formation substrate which are understood to display a relative increased or decreased flow of a displacement substance, e.g. flood fluid, upon injection in the formation.

The first location may be in fluid communication with the formation, e.g. with the first region and/or second region thereof.

The second location may be in fluid communication with the formation, e.g. with the first region and/or second region thereof.

The first location and the second location may be the same or different.

Advantageously, the first location and the second location may be different, may be separate and/or may be distal from each other. By such provision, in use, the first composition may preferentially enter and/or may be preferentially directed into the first region from the first location, and the second composition may preferentially enter and/or may be preferentially directed into the first region from the second location, e.g. in opposite directions and/or from opposite ends thereof. As a result, the first composition and the second composition may react, e.g. may preferentially and/or selectively react, to form a reaction product in the first region. The low permeability of the second region may not permit a substantial amount of the first component and/or of the second component to enter and/or to be directed into the second region. As a result, the present method may reduce, minimise and/or prevent reaction of the first composition and the second composition in the second region. Thus, the present method may advantageously assist in at least partially plugging and/or reducing permeability of the first region (e.g. region of high permeability), while reducing, minimising and/or preventing plugging in the second region (e.g. region of low permeability). By such provision, the recovery factor during subsequent oil recovery, e.g. by flooding, may be increased as the displacement substance, e.g. flood fluid, may be forced to displace hydrocarbons in the second region of low permeability. In addition, injecting the first composition and the second composition from different or separate locations, e.g. respectively from at least one first or production wellbore and from at least one second or injection wellbore, may reduce the amount of reaction product in the first and/or in the second wellbores, thereby reducing the risk of accidentally plugging the first and/or second wellbores.

The first and second locations may be located on substantially opposite sides of the formation and/or first region thereof. It will be appreciated that the precise disposition to the first and second locations may be selected depending on the particular profile and/or characteristics of the formation.

The first location may comprise and/or may be defined by one of more first wellbores. One or more first wellbores may typically comprise one or more production wellbores or injection wellbores, typically one or more production wellbores.

The second location may comprise and/or may be defined by one of more second wellbores. One or more second wellbores may typically comprise one or more injection wellbores or production wellbores, typically one or more injection wellbores.

Advantageously, the first composition may be injected from at least one production wellbore or injection wellbore. The second composition may be injected from the other of at least one injection wellbore or production wellbore. By such provision, the first and second compositions may be provided to the first region separately, such that the first and second compositions may preferentially contact one another and/or react once within the first area of permeability. These features are not expected to be achieved by plugging methods of the prior art which use a single conformance controlling fluid and/or a single well or source of fluid provision for injection into the formation.

The method may comprise the preliminary step of injecting a displacement substance, e.g. flood fluid, such as water, in the at least one first wellbore and/or the at least one second wellbore. The method may comprise filling and/or saturating the at least one first wellbore and/or the at least one second wellbore with a displacement substance, e.g. flood fluid, such as water.

The method may comprise closing the second wellbore, e.g. injection wellbore. The method may comprise closing the second wellbore above and/or below the first region. By such provision any substance injected from the first wellbore, e.g. production wellbore, may not significantly enter the second wellbore, thus reducing risks of contamination and/or plugging of the second wellbore.

The method may comprise opening the first wellbore, e.g. production wellbore.

The method may comprise injecting a displacement substance, e.g. flood fluid such as water, in the first wellbore, e.g. production wellbore. This may fill the first wellbore, e.g. production wellbore, the second wellbore, e.g. injection wellbore, and/or the first region, with displacement substance, e.g. water. As such displacement substance such as water may be an incompressible fluid, this may prevent other fluids from entering the wellbore(s) except in cases with significant cross-flow.

The method may comprise injecting the first composition in the first region from the first location.

The first composition may have a viscosity greater than the viscosity of the displacement substance, e.g. water, for example by a factor of approximately 2-20, e.g. 2-10, e.g. 5-10. By such provision, injection of the first composition may displace at least a portion of the displacement substance, e.g. water, out of the first region, for example into a portion of the second region near or adjacent to the first region.

The first composition may be designed or configured to degrade and/or disintegrate within a predetermined period of time, e.g. 0-1 month, e.g. 0-1 week, e.g. 1-5 days, e.g. 2-3 days. By such provision, reduction in permeability of the second region, e.g. region of low permeability, for example near the first region, may be avoided. Further, this may help avoid producing unreacted polymer gel and contaminating hydrocarbons during subsequent enhanced oil recovery procedures.

The method may comprise measuring and/or monitoring pressure, e.g. bottom-hole pressure (BHP), in the first location or first wellbore and/or in the second location or second wellbore, advantageously both in the first wellbore and in the second wellbore. A sharp increase in BHP in the first location, e.g. production wellbore, may indicate that injection of the first composition should be ceased. Without wishing to be bound by theory, it is believed that such an increase in BHP in the first location may indicate that the first composition has substantially filled or saturated the first region (e.g. of high permeability), and is about to enter the second region (e.g. of low permeability).

The method may comprise closing the first wellbore, e.g. production wellbore. The method may comprise closing the first wellbore above and/or below the first region. By such provision any substance injected from the second wellbore, e.g. injection wellbore, may not significantly enter the first wellbore, thus reducing risks of contamination and/or plugging of the first wellbore.

The method may comprise opening the second wellbore, e.g. injection wellbore.

The method comprises injecting the second composition in the first region from the second location.

The ratio, e.g. molar ratio, of the second composition to the first composition may be less than or equal to 1:1, e.g. may be less than 1:1. In one embodiment, the molar ratio, of the second composition to the first composition may be in the range of 0.5:1-1:1, e.g. 0.8:1-1:1. By such provision, the amount of unreacted reactants in the second composition may be minimised or reduced. This may be particularly advantageous if the second composition is not designed or configured to degrade and/or disintegrate under the conditions in the first region.

The first composition may have a viscosity greater than the viscosity of the second composition. By such provision, injection of the second composition may displace at least a portion of the displacement substance, e.g. water, present in the first region, out of the first region, for example into a portion of the second region near or adjacent to the first region, in preference to displacing the more viscous first composition. Advantageously, this may assist in promoting mixing of the first composition and second composition within the first region, for example by creating "viscous fingering" of the second composition through the more viscous first composition.

The method may comprise reacting and/or allowing to react the first composition with the second composition, at least in the first region and/or in situ, to form a reaction product. The reaction product may be capable of plugging and/or reducing the permeability of the first region.

The terms "react", "reacting", and "reaction" will be herein understood as referring to any reaction, including physical and/or chemical reactions, between two or more compounds. There terms will therefore not be understood to be limited to the formation of covalent bonds, and may also include, e.g., hydrogen bonds, Van der Walls interaction, chelation, physical interaction, adsorption, viscosification, etc.

Advantageously, the first and second composition may be designed and/or selected to react after a predetermined amount of time, after a predetermined delay, so as to help and/or promote adequate mixing in the first region before reaction. Advantageously, this may help plugging of a relatively large zone of the first region. In contrast, an instantaneous or quick reaction may cause plugging within a limited zone of the first region, e.g. where the first and second compositions may initially mix, and may provide only limited plugging of the first region.

The method may comprise closing the second wellbore, e.g. closing both the first wellbore and the second wellbore. The method may comprise closing the first wellbore and the second wellbore after injection of the first composition and/or second composition, e.g. after injection of the first composition and of the second composition is complete.

The method may comprise maintaining the first wellbore and/or the second wellbore, typically both the first wellbore and the second wellbore, in a closed configuration, for a predetermined amount of time. The amount of time may be selected to allow reaction between the first composition and the second composition to occur. It will be appreciated that the amount of time may depend on the conditions expected in the first region, such as temperature, pressure, pore size, reservoir properties, etc.

In an embodiment, the method may comprise injecting the first composition and the second composition simultaneously. By simultaneously, it is meant that the first composition and the second composition may be injected substantially at the same time, although the first location and second location may be different.

In another embodiment, the method may comprise injecting the first composition and the second composition alternately, e.g. the method may comprise alternating injection of the first composition and the second composition. Advantageously, this may permit filling and/or saturation of the first region with the first composition, before injection of the second composition, which may lead to a more complete plugging of the first region.

The first location may comprise and/or may be defined by one or more production wellbores. In such instance, the method may comprise injecting the first composition in the first region from at least one production wellbore. The second location may comprise and/or may be defined by one or more injection wellbores, and thus the second composition may be injected from at least one injection wellbore. Advantageously, injecting the first composition from at least one production wellbore, and the second composition from at least one injection wellbore, may avoid the need to back-produce the second composition before carrying out oil recovery. This is to avoid the presence of any unreacted cross-linker, e.g. in the production wellbore, which would need to be recovered to avoid contamination of hydrocarbons during subsequent oil recovery. Further, the cross-linker may comprise metal species such as chromium complexes, which it is not desirable to leave unreacted in the environment, such as underground, for environmental reasons. The present method may avoid, minimise or reduce the amount of unreacted cross-linker in and/or near the formation.

The method may comprise opening the first wellbore and/or the second wellbore, typically both the first wellbore and/or the second wellbore.

The method may further comprise producing the formation, for example using one or more Enhanced Oil Recovery techniques.

In one embodiment, the method may comprise injecting a displacement substance, e.g. a flood fluid, such as water, in the formation. Typically, the method may comprise injecting the displacement substance from at least one second wellbore, e.g. injection wellbore. The method may comprise recovering oil from at least one first wellbore, e.g. production wellbore. Advantageously, because the permeability of the first region has been reduced by reaction of the first and second compositions, the recovery factor may be increased.

Beneficially, injection of the displacement substance, e.g. water, into the formation may cause any unreacted reactant of the second composition to flow, e.g. towards the first wellbore, e.g. production wellbore, and react with any unreacted reactant of the first composition.

In one embodiment, the method may comprise performing the steps of injecting the first composition and injecting the second composition once.

In other embodiments, the method may comprise performing the steps of injecting the first composition and injecting the second composition, more than once, e.g. two or more times. The method may comprise repeatedly performing the steps of injecting the first composition and injecting the second composition. The method may comprise repeatedly performing the steps of injecting the first composition and injecting the second composition simultaneously and/or alternately, preferably alternately. Performing the steps of injecting the first composition and injecting the second composition may be required more than once, for example, if complicated drainage patterns occur where fluid communication between first and second wellbores has not been clearly established, if several wellbores are connected by more than one first region of high-permeability, or the like.

The first and second composition may be designed and/or selected to react under the particular conditions expected in the first region, such as temperature, pressure, pore size, and other reservoir properties, etc.

The first composition may comprise a gel, and/or may be provided in the form of a gel. This may ensure that the viscosity of the first composition is greater than the viscosity of the displacement substance, e.g. water, and/or of the second composition.

The first composition may comprise a polymeric material. Advantageously, the first composition may comprise at least one crosslinkable polymer.

The first composition may comprise at least one degradable polymer. At least one degradable polymer may be designed or configured to degrade and/or disintegrate within a predetermined period of time, e.g. 0-1 month, e.g. 0-1 week, e.g. 1-5 days, e.g. 2-3 days. By such provision, reduction in permeability of the second region, e.g. region of low permeability, for example near the first region, may be avoided. Further, this may help avoid producing unreacted polymer gel and contaminating hydrocarbons during subsequent enhanced oil recovery procedures.

In one embodiment, the first composition may comprise natural or modified polysaccharides, e.g. guar gum, arabic gum, xanthan gum, alginic acid, and derivatives thereof, or cellulosic polymers and derivatives thereof such as cellulose ethers, esters, and the like.

In other embodiments, the first composition may comprise polymers, e.g. addition polymers such as homo- and/or or copolymers of polyvinyl alcohol (PVA), polyacrylamine (PA), polyacrylamine (PA), hydrolysed polyacrylamine (HPAM), partially hydrolysed polyacrylamine (PHPA), polyvinyl pyrrolidone (PVP), and the like.

In other embodiments, the first composition may comprise a gelling system, e.g. an inorganic gelling system such as a Delayed Gelation System (DGS), for example a partially hydrolysed aluminium chloride system, or a colloidal dispersion gel (CDG).

The second composition may comprise at least one crosslinker.

The second composition, e.g. crosslinker, may be chosen or selected so as to react, e.g. form a reaction product, with the first composition, e.g. in situ.

The second composition may comprise one or more polyvalent ions, e.g. polyvalent metallic ions, such as magnesium, aluminium, chromium, antimony, titanium, zirconium, or the like. The one or more polyvalent ions may be provided in the form of salts, chelates, complexes, or the like, for example aluminium hydroxyl chloride, chromium acetate, chromium malonate, or aluminium citrate. In one embodiment, the second composition may comprise chromium acetate.

The second composition may comprise a multifunctional compound, e.g. a multifunctional organic compound, such as a phenolic resin, e.g. phenol-formaldehyde resin.

When the first composition comprises a Delayed Gelation System (DGS), the second composition may comprise an activator, for example an activator which may respond to a characteristic of in the first region, e.g. temperature, to alter the environment, e.g. pH, which may cause the first composition to react and/or form a gel.

In one embodiment, the reaction product may comprise and/or may define a crosslinked polymer, e.g. a crosslinked gel.

First composition and/or second composition may further comprise one or more additive, such as mixing additives, viscosity modifiers, stabilisers, etc.

In one embodiment, the second composition may comprise at least one mixing additive, which may assist in improving the mixing of the first composition and the second composition, e.g. within the first region.

The at least one additive may be provided in solid form, liquid form, gel form, or any other suitable form. In one embodiment, the at least one additive, e.g. mixing additive, may be provided in solid form, e.g. in particulate form.

The at least one additive, e.g. mixing additive, may comprise a particle, e.g. a nano-particle, which may help mixing and dispersing within the first composition and/or second composition.

The at least one additive, e.g. mixing additive, may comprise and/or may be associated with one or more reactants of the first composition and/or second composition. In one embodiment, the at least one additive, e.g. mixing additive, may comprise particles, e.g. nano-particles, coated with the second composition, e.g. crosslinker(s).

The particles, e.g. nano-particles, may comprise metallic particles, inorganic particles such as $SiO_2$, super paramagnetic materials, or the like.

The particles, e.g. nano-particles, may have a dimension or size, e.g. diameter, of 1 nm-100 microns, e.g. 1 nm-10 microns. The term diameter will be herein understood as referring to a general dimension across the particles, but will not be limited to particles of spherical shape.

According to a second aspect of the present invention there is provided a method for recovering hydrocarbons from a formation, comprising:

injecting a first composition in a first region of the formation from a first location near or and/or adjacent the first region, and injecting a second composition in the first region from a second location near or and/or adjacent the first region, wherein the first composition and the second composition are configured to react so as to form a reaction product capable of reducing the permeability in at least a portion of the first region; and injecting a displacement substance in the formation to displace hydrocarbons from the formation.

The method may comprise injecting a flood fluid, such as water, in the formation, to displace hydrocarbons from the formation.

The method may comprise injecting the first composition from at least one first wellbore, e.g. production wellbore.

The method may comprise injecting the second composition from at least one second wellbore, e.g. injection wellbore.

The method may comprise injecting the displacement substance, e.g. water, from at least one second wellbore, e.g. injection wellbore.

The method may comprise recovering hydrocarbons from at least one first wellbore, e.g. production wellbore.

The features described in relation to any other aspect or the invention, can apply in respect of the method according to a second aspect of the present invention, and are therefore not repeated here for brevity.

According to a third aspect of the present invention there is provided a method for reducing permeability in a first region of a formation, comprising:

injecting a first composition in the first region; and injecting a second composition in the first region;

wherein the first composition and the second composition are configured to react in situ so as to form a reaction product capable of reducing the permeability in at least a portion of the first region.

The features described in relation to any other aspect or the invention, can apply in respect of the method according to a third aspect of the present invention, and are therefore not repeated here for brevity.

According to a fourth aspect of the present invention there is provided a method substantially as described with reference to the accompanying drawings.

BRIEF DESCRIPTION OF THE DRAWINGS

These and other aspects of the present invention will now be described, by way of example only, with reference to the accompanying drawings, in which.

DETAILED DESCRIPTION OF THE DRAWINGS

Figure 1A:
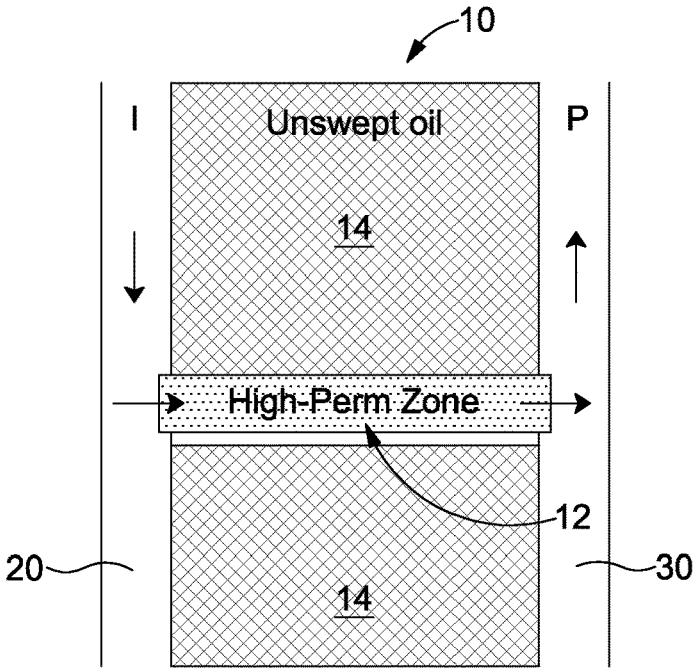
FIG. 1A is a schematic cross-sectional view of a formation comprising a region of high permeability and regions of low permeability.

FIG. 1A is a schematic cross-sectional view of a formation 10 comprising a first region 12 of high permeability and second regions 14 of low permeability.

The method according to the present invention aims to reduce the permeability in the first region 12 of formation 10.

An injection well 20 and a production well 30 are provided on either side of the formation 10, and in this embodiment on either side of the first region 12. It will be appreciated, however, that the precise disposition to the injection well 20 and production well 30 may be selected depending on the particular profile and/or characteristics of each particular formation 10 being produced.

As shown by the arrows on FIG. 1A, should Enhanced Oil Recovery techniques be implemented in the formation of FIG. 1A, the injected EOR fluid would preferentially enter and travel through the formation through the first region 12 of high permeability, thus achieving unsatisfactory oil recovery factors.

FIG. 1A shows a preliminary step of an embodiment of the method according to the present invention. In this embodiment, the preliminary step comprises injecting water in the injection wellbore 20, so as to fill the injection wellbore 20, the first region 12, and the production wellbore 30, with water. As water is an incompressible fluid, this helps avoid or prevent other fluids from entering the injection wellbore 20 or production wellbore 30, except in cases with significant cross-flow.

Figure 1B:
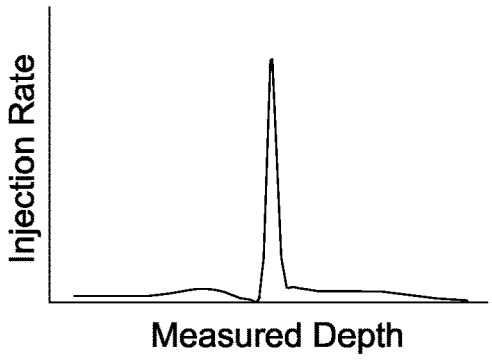
FIG. 1B is a graph showing the water injection rate ($m^3/h$) through the formation of FIG. 1A based on measured depth along wellbore (ft MDRT)

FIG. 1B is a graph showing the water injection rate ($m^3/h$) through the formation 10 based on measured depth along wellbore (ft MDRT). It can be seen that water flows through the first region 12 of high permeability in preference to the second region 14 having low permeability.

Figure 2:
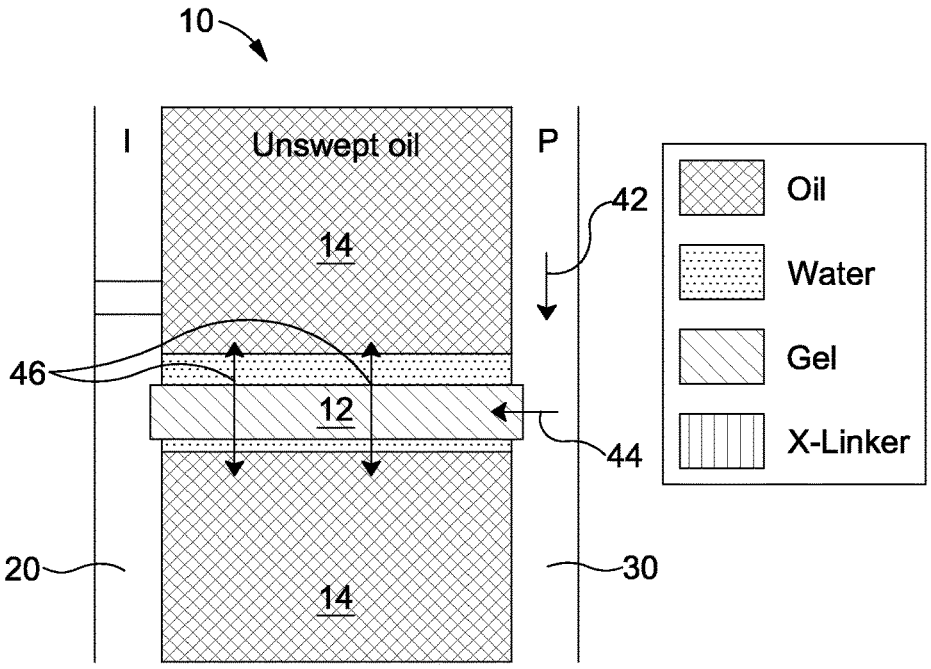
FIG. 2 is a schematic cross-sectional view of a first step of a method for reducing permeability in the region of high permeability shown in FIG. 1, according to an embodiment of the present invention.

FIG. 2 is a schematic cross-sectional view of a first step of a method for reducing permeability in the first region of high permeability 12 of formation 10.

As shown in FIG. 2, the method comprises closing the injection wellbore 20, while opening the production wellbore 30. In this embodiment, the injection wellbore 20 is closed above the first region 12. However, in other embodiments, the injection wellbore 20 may additionally or alternatively be closed below the first region 12, for example by using a so-called "bridge plug". By such provision the first composition injected from the production wellbore 30 may not significantly enter the injection wellbore 20, thus reducing risks of contamination and/or plugging of the injection wellbore 20.

The method comprises injecting a first composition in the production wellbore 30 which is in fluid communication with the first region 12, in the direction of arrows 42. The first composition enters and permeates the first region 12 in preference to the second region 14 due to the high permeability of the first region 12, as shown by arrows 44. Because the first composition has a viscosity greater than the viscosity of water, for example by a factor of approximately 5-10, injection of the first composition displaces at least a portion of the water from the first region 12 into a portion of the second region 14 surrounding the first region 12, as shown by arrows 46.

In order to determine when injection of the first composition should be stopped, the method comprises measuring and/or monitoring pressure bottom-hole pressure (BHP) at least in the production wellbore 30, and advantageously both in the injection wellbore 20 and in the production wellbore 30. A sharp increase in BHP in the production wellbore indicates that injection of the first composition should be ceased. Without wishing to be bound by theory, it is believed that such an increase in BHP in the production wellbore indicates that the first composition has substantially filled or saturated the first region 12, and is about to enter the second region 14 surrounding the first region 12.

In this embodiment, the first composition comprises a crosslinkable polymer such as hydrolysed polyacrylamine (HPAM), partially hydrolysed polyacrylamine (PHPA).

The polymer is provided in the form of a gel, to ensure that the viscosity of the polymer is greater than the viscosity of the water in the first region 12.

The polymer is degradable. The degradable polymer is designed or configured to degrade and/or disintegrate within a predetermined period of time, in this embodiment 2-3 days. By such provision, reduction in permeability of the second region 14 of low permeability, for example near the first region 12, may be avoided. Further, this may help avoid producing unreacted polymer gel and contaminating hydrocarbons during subsequent EOR procedures.

Figure 3:
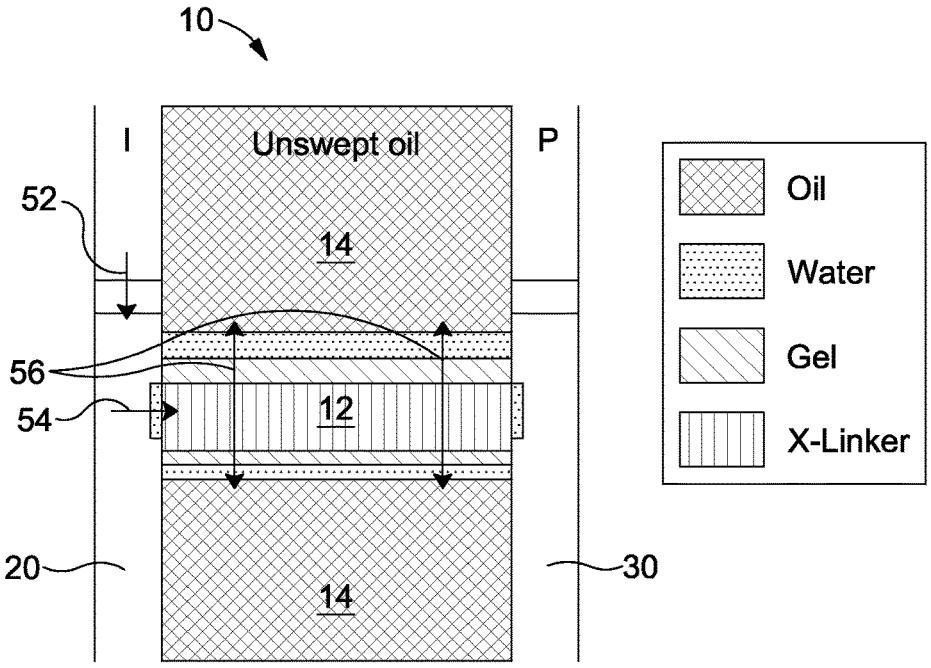
FIG. 3 is a schematic cross-sectional view of a second step of the method of FIG. 2.

FIG. 3 is a schematic cross-sectional view of a second step of the method of FIG. 2.

As shown in FIG. 3, the production wellbore 30 has been closed, and the injection wellbore 20 has been opened. In this embodiment, the production wellbore 30 is closed above the first region 12. However, in other embodiments, the production wellbore 30 may additionally or alternatively be closed below the first region 12, for example by using a so-called "bridge plug". By such provision the second composition injected from the injection wellbore 20 may not significantly enter the production wellbore 30, thus reducing risks of contamination and/or plugging of the production wellbore 30.

The method comprises injecting a second composition in the injection wellbore 20 which is in fluid communication with the first region 12, in the direction of arrows 52. The second composition enters and permeates the region 12 in preference to the second region 14 due to the high permeability of the first region 12, as shown by arrows 54. Because the first composition has a viscosity greater than the viscosity of water and of the second composition, injection of the second composition displaces at least a portion of the water present in the first region 12 out of the first region 12, and into a portion of the second region 14 surrounding the first region 12, as shown by arrows 56, in preference to displacing the more viscous first composition. Advantageously, this may assist in promoting mixing of the first composition and second composition within the first region 12, for example by creating "viscous fingering" of the second composition through the more viscous first composition.

Because the first composition and the second composition are injected from different wellbores 20,30 at opposite sides of the formation, the first and second composition preferentially enter, permeate, mix, and react, in the first region 12. In contrast, the low permeability of the second region 14 does not permit a substantial amount of the first component and/or of the second component to enter and/or to be directed into the second region 14. Therefore, the present method advantageously permits at least partially plugging and/or reducing permeability of the first region 12, while reducing, minimising and/or preventing plugging in the second region 14. As a result, the recovery factor during subsequent oil recovery, e.g. by water flooding, can be significantly increased as the displacement substance, e.g. water, is forced to displace hydrocarbons in the second region 14 of low permeability.

The amount of the second composition injected from the injection wellbore is such that the molar ratio of the second composition to the first composition is less than or equal to 1:1, e.g. in the range of 0.8:1-1:1. By such provision, the amount of unreacted reactants in the second composition is minimised or reduced. This may be particularly advantageous when the second composition is not designed or configured to degrade and/or disintegrate under the conditions in the first region 12.

In this embodiment, the first composition comprises a crosslinking composition, which comprises at least one crosslinker, which may comprise one or more crosslinkers selected from the list consisting of aluminium hydroxyl chloride, chromium acetate, chromium malonate, or aluminium citrate.

Figure 4:
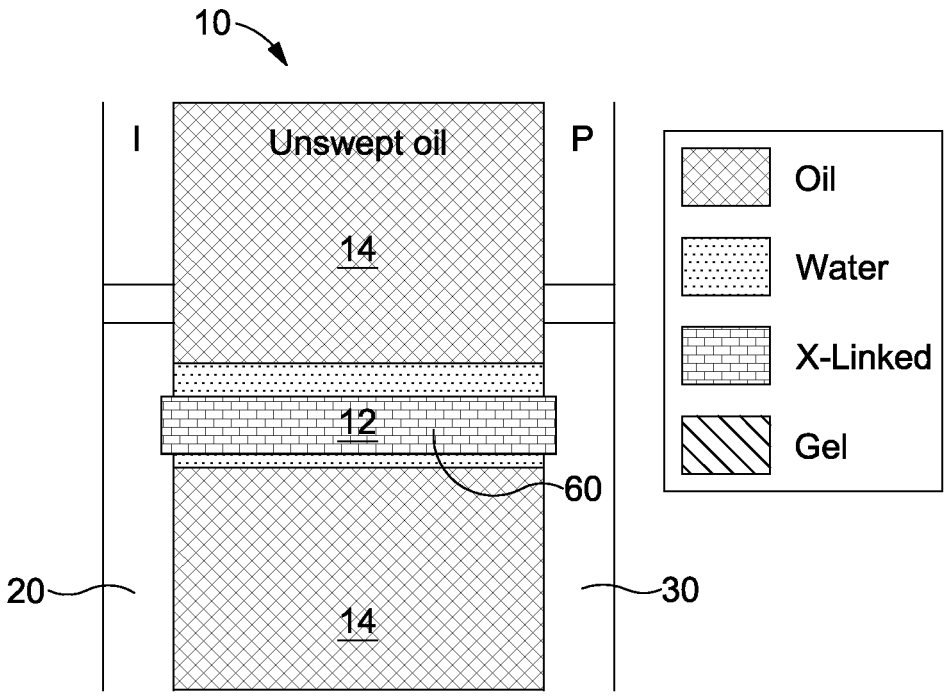
FIG. 4 is a schematic cross-sectional view of a third step of the method of FIGS. 2 and 3.

FIG. 4 is a schematic cross-sectional view of a third step of the method of FIGS. 2 and 3.

In this step, both the injection wellbore 20 and the production wellbore 30 are closed, and the first composition and the second composition are left to react in the first region 12.

The first and second composition are designed and/or selected to react after a predetermined amount of time, so as to help and/or promote adequate mixing in the first region 12 before reaction, as shown in FIG. 4 in which a relatively large zone of the first region 12 is plugged by the reaction product 60 of the first composition and the second composition. In contrast, an instantaneous or quick reaction would cause plugging within a limited zone of the first region 12, e.g. at the point where the first and second compositions would initially mix.

In this embodiment, the reaction product 60 comprises a crosslinked polymer gel.

The method may further comprise performing enhanced oil recovery techniques in the formation 10, particularly oil recovery by water, gas or chemical displacement, by injecting water in injection wellbore 20 and recovering oil via production wellbore 30.

Various modifications may be made to the embodiment described without departing from the scope of the invention.

The invention claimed is:

1. A method for reducing permeability in a first region of a formation, comprising:

injecting a first composition into the first region from a first location near or adjacent the first region, the first composition including a gel; and injecting a second composition into the first region from a second location near or adjacent the first region so as to mix and react with the first composition to form a crosslinked polymer gel as a reaction product in the first region that reduces the permeability in at least a portion of the first region, the second composition including at least one crosslinker, a molar ratio of the second composition to the first composition being less than 1:1, the second location being separate from the first location, a viscosity of the first composition being greater than a viscosity of the second composition such that the injecting of the second composition creates a viscous fingering of the second composition through the first composition so as to promote a mixing of the first composition and the second composition within the first region.

2. The method according to claim 1, wherein the method comprises reacting the first composition and the second composition in situ.

3. The method according to claim 1, wherein the first region of the formation comprises a region having a first permeability.

4. The method according to claim 1, wherein the formation comprises a second region having a permeability less than the permeability of the first region.

5. The method according to claim 4, wherein the first location and the second location are in fluid communication with the first region or the second region.

6. The method according to claim 1, wherein the first location and the second location are located on opposite sides of the first region.

7. The method according to claim 1, wherein the first location comprises or is defined by one or more first wellbores.

8. The method according to claim 7, wherein the one or more first wellbores comprises one or more production wellbores.

9. The method according to claim 1, wherein the second location comprises or is defined by one or more second wellbores.

10. The method according to claim 9, wherein the one or more second wellbores comprises one or more injection wellbores.

11. The method according to claim 1, wherein the first location comprises or is defined by one or more first wellbores, wherein the second location comprises or is defined by one or more second wellbores, and wherein the method comprises a preliminary step of injecting a displacement substance in the one or more first wellbores, the one or more second wellbores, and the first region.

12. The method according to claim 11, wherein the displacement substance comprises water.

13. The method according to claim 11, wherein the viscosity of the first composition is greater than the viscosity of the displacement substance.

14. The method according to claim 1, wherein the method comprises measuring or monitoring pressure in the first location or in the second location.

15. The method according to claim 1, wherein the first composition and the second composition are designed or selected to react after a predetermined amount of time.

16. The method according to claim 1, wherein the method comprises injecting the first composition and the second composition alternately.

17. The method according to claim 1, further comprising producing the formation.

18. The method according to claim 17, comprising injecting a displacement substance in the formation.

19. The method according to claim 1, wherein the method comprises performing the steps of injecting the first composition and injecting the second composition once.

20. The method according to claim 1, wherein the method comprises repeatedly performing the steps of injecting the first composition and injecting the second composition.

21. The method according to claim 1, wherein the gel of the first composition comprises an inorganic gelling system.

22. The method according to claim 1, wherein the second composition comprises an activator.

23. The method according to claim 1, wherein the first composition or the second composition comprises a mixing additive.

24. The method according to claim 23, wherein the mixing additive is provided in particulate form.

25. A method for recovering hydrocarbons from a formation, comprising:

injecting a first composition into a first region of the formation from a first location near or adjacent the first region, the first composition including a gel;

injecting a second composition into the first region from a second location near or adjacent the first region so as to mix and react with the first composition to form a crosslinked polymer gel as a reaction product in the first region that reduces a permeability in at least a portion of the first region, the second composition including at least one crosslinker, a molar ratio of the second composition to the first composition being less than 1:1, the second location being separate from the first location, a viscosity of the first composition being greater than a viscosity of the second composition such that the injecting of the second composition creates a viscous fingering of the second composition through the first composition so as to promote a mixing of the first composition and the second composition within the first region; and injecting a displacement substance in the formation to displace hydrocarbons from the formation.

26. The method according to claim 25, wherein the method comprises injecting the displacement substance from at least one injection wellbore.

27. The method according to claim 25, wherein the method comprises recovering hydrocarbons from at least one production wellbore.

* * * * *